US008808046B2

(12) United States Patent
Lockett et al.

(10) Patent No.: US 8,808,046 B2
(45) Date of Patent: Aug. 19, 2014

(54) PROTECTIVE BRIDLE FOR WATERSKIING

(71) Applicants: Eldred C. Lockett, Reno, NV (US); Gordon Rathbun, Sunnyvale, CA (US)

(72) Inventors: Eldred C. Lockett, Reno, NV (US); Gordon Rathbun, Sunnyvale, CA (US)

( * ) Notice: Subject to any disclaimer, the term of this patent is extended or adjusted under 35 U.S.C. 154(b) by 112 days.

(21) Appl. No.: 13/681,841

(22) Filed: Nov. 20, 2012

(65) Prior Publication Data

US 2014/0141666 A1 May 22, 2014

(51) Int. Cl.
*B63B 35/81* (2006.01)

(52) U.S. Cl.
CPC ..... *B63B 35/816* (2013.01)
USPC ..... 441/69

(58) Field of Classification Search
USPC ..... 441/69; 114/253
See application file for complete search history.

(56) References Cited

U.S. PATENT DOCUMENTS 2,878,013 A * 3/1959 Piodi ..... 114/253
7,959,481 B1 * 6/2011 Wayne ..... 441/69

* cited by examiner

*Primary Examiner* — Lars A Olson
(74) *Attorney, Agent, or Firm* — William H. Eilberg

(57) ABSTRACT

A protective bridle for waterskiing includes a handle connected to a pair of ski lines, the lines being joined at a point. The handle and lines together define a generally triangular region. The bridle includes a barrier which fills out substantially all of the triangular region, and thus prevents a limb, or other body part, from passing through the bridle in the event of a fall. The bridle may also include a flat plate, connected to the lines, and located within the triangular region. The flat plate stabilizes the bridle, and tends to prevent the bridle from spinning if the bridle is dropped into the water. The invention also includes a waterski line having sections of differing elasticities, enabling a student waterskier to train using a line that does not stretch excessively.

12 Claims, 4 Drawing Sheets

PROTECTIVE BRIDLE FOR WATERSKIING

BACKGROUND OF THE INVENTION

The present invention provides a protective bridle for waterskiers. The bridle helps to prevent serious injury in the event of a fall.

In the sport of waterskiing, an athlete is pulled by a ski line which is attached to a motorboat. The interface between the waterskier and the line is called a bridle. The bridle includes a handle, having the form of a generally cylindrical bar, which can be gripped by the waterskier with one or both hands. The ends of the handle are connected to cables or cords, made of the same kind of material, typically polypropylene, as the ski line. These cords join each other, at a point forward of the handle, to form a single line pulled by the boat. Thus, the bridle has a generally triangular configuration, as shown in FIG. 1.

The waterski bridles of the prior art have included an open triangular region. That is, there is substantial open space between the ski lines connected to the ends of the handle. This open space creates a hazard, especially when waterskiing is conducted at high speeds.

In high-speed waterskiing, there are many occasions when the waterskier is traveling faster than the boat. This is the result of the fact that, while maneuvering around obstacles in a curved path, the waterskier travels along a path which is longer than that traversed by the boat. In many such situations, the waterskier may be moving at speeds of tens of miles per hour, and sometimes up to about seventy miles per hour.

If a ski becomes stuck, either because of an obstacle in the water, or due to an improper movement of the skier, the skier will continue to move forward due to inertia. In such a situation, the skier's arm or head may be pushed rapidly and with great force through the bridle. Due to the high speed of the skier, the above effect will likely cause serious injury or even death. At high speeds, the open bridle used in waterskiing is a significant hazard.

The present invention provides an improved bridle for waterskiing, which virtually eliminates the possibility of injury due to the movement of body parts through the bridle.

The invention also provides additional improvements in the bridle, and in the ski line connecting the bridle with the boat.

SUMMARY OF THE INVENTION

The present invention comprises a protective bridle for waterskiing. The bridle includes a handle having two ends, and a pair of ski lines extending respectively from the ends of the handle, the ski lines joining at a point, such that the handle and the lines together define a generally triangular region. In the prior art, the triangular region is open. But in the bridle of the present invention, this triangular region is closed off.

The bridle of the present invention includes a barrier having two sections which are inclined in mutually opposite directions. A wall connects both sections, and is generally perpendicular thereto. The bridle also includes end walls, connected to the respective sections. The barrier and walls fill out substantially all of the space defined by the triangular region, and prevent a limb, or other body part, from passing through the bridle.

In a preferred embodiment, the bridle also includes a generally flat plate, connected to the ski lines defining the bridle, and located within the triangular region of the bridle. The flat plate is preferably positioned in the forward portion of the bridle, i.e. farther away from the waterskier and closer to the boat. The plate tends to stabilize the bridle in the event that the bridle falls into the water. If such a fall occurs, the bridle is less likely to spin, because the plate tends to resist a twisting movement in the water.

In another preferred embodiment, the bridle is connected to a waterski line having sections of differing elasticities. A line having relatively low elasticity, i.e. a line with high tensile strength and relatively low tendency to stretch, is connected to the boat. A line having higher elasticity, i.e. a line with less tensile strength, and a greater tendency to stretch, is connected to the bridle. These two line sections are connected together to form, effectively, a single line. The ski line thus formed can be used advantageously by beginning skiers, who are not yet competent to ski with lines having an excessive tendency to stretch.

The above described features may be used individually or in any combination.

The present invention therefore has the primary object of providing a protective bridle for waterskiers, wherein the bridle prevents passage of a limb, or other body part, through the region defined by the bridle.

The invention has the further object of enhancing the safety of the sport of waterskiing, by preventing injury or death, due to passage of body parts through a waterski bridle.

The invention has the further object of providing a safety apparatus for use in high-speed waterskiing.

The invention has the further object of preventing a waterski bridle from spinning in the event that the bridle is dropped into the water.

The invention has the further object of providing a waterski line having varying elasticities along its length, for use in training a student waterskier.

The reader skilled in the art will recognize other objects and advantages of the present invention, from a reading of the following brief description of the drawings, the detailed description of the invention, and the appended claims.

DETAILED DESCRIPTION OF THE INVENTION

Figure 1:
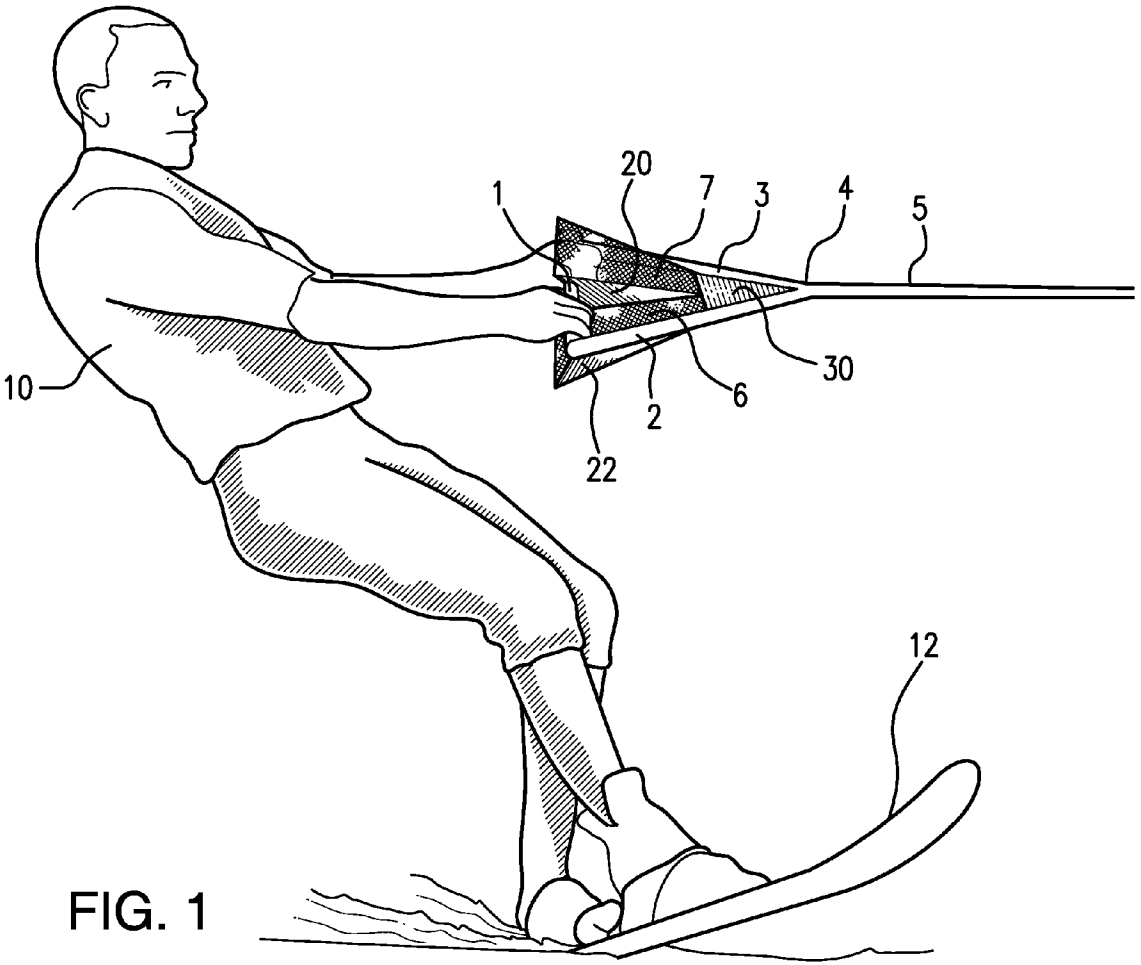
FIG. 1 provides a perspective view showing a waterskier holding a protective bridle made according to the present invention.
Figure 2:
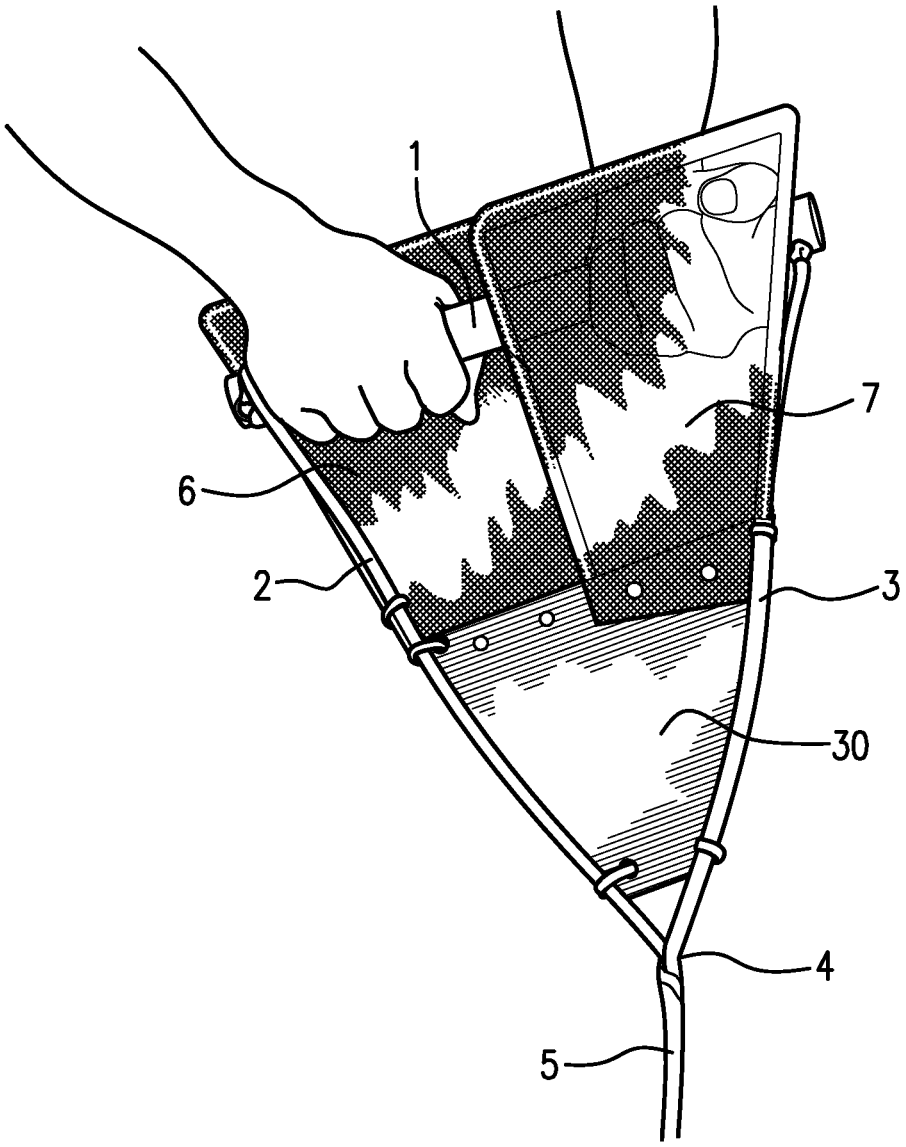
FIG. 2 provides another perspective view, generally showing the top of the protective bridle of the present invention.

FIGS. 1 and 2 illustrate the protective bridle of the present invention. A waterskier 10, standing on waterski 12, grips handle 1, which is preferably a generally cylindrical structure. The ends of the handle are connected to ski lines 2 and 3, which are cords or cables typically made of polypropylene. These ski lines 2 and 3 become joined to each other at a point identified by reference numeral 4, and after the point of joinder, the separate lines become a single ski line 5 which provides a connection to a motorboat (not shown).

In the prior art, the bridle comprises only the handle and the two ski lines connected to the ends of the handle, the lines being joined as shown. Thus, in the prior art, the bridle comprises an open triangular region defined by the handle and the lines. As explained above, this open region creates a hazard, because in the event of a sudden deceleration of the waterskier, the waterskier's arms or head will continue to move, due to inertia, and may pass through the open region of the bridle.

In the protective bridle of the present invention, substantially all of the triangular region is closed off, and it is no longer possible for a limb, or other body part, of the waterskier to pass through.

As shown in the drawings, a waterskier grasps the handle 1 in the same manner in which one would hold a baseball bat. That is, the palm of one hand faces in a direction opposite to that of the palm of the other hand. In the example shown in FIG. 1, the palm of the waterskier's right hand faces downward, and the palm of the waterskier's left hand faces upward.

The present invention therefore provides a barrier having sections 6 and 7. These barrier sections are generally planar, and are inclined in mutually opposite directions, according to the positioning of the hand of the waterskier. In the example of FIGS. 1 and 2, the barrier section 6 corresponds to the waterskier's right hand, in which the palm faces down. Therefore, barrier section 6 is a downwardly extending structure. The barrier section 7 corresponds to the waterskier's left hand, in which the palm faces up. Thus, barrier section 7 is an upwardly extending structure.

The barrier sections are shown to have the form of a mesh, which could be made of metal or plastic, or other material. But the barrier sections could instead be made of a solid material, such as metal or plastic, or other material.

Figure 4:
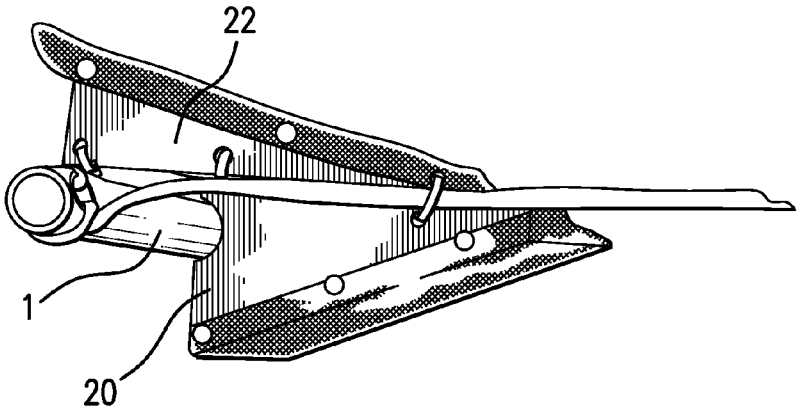
FIG. 4 provides another perspective view, generally showing a side portion of the protective bridle of the present invention.

The orientations of the barrier sections 6 and 7 could be reversed. For example, if the waterskier's left hand is to be oriented such that the palm faces downward, it would be barrier section 7 that extends downwardly, and barrier section 6 that extends upwardly. Thus, the orientation of the barrier sections can be chosen according to whether the waterskier is right handed or left handed. FIG. 4 is drawn so as to show this alternative; in FIG. 4, it is apparent that the barrier section to the waterskier's right extends upwardly, and the barrier section to the waterskier's left extends downwardly. In all cases, the barrier sections extend in mutually opposite directions.

Figure 3:
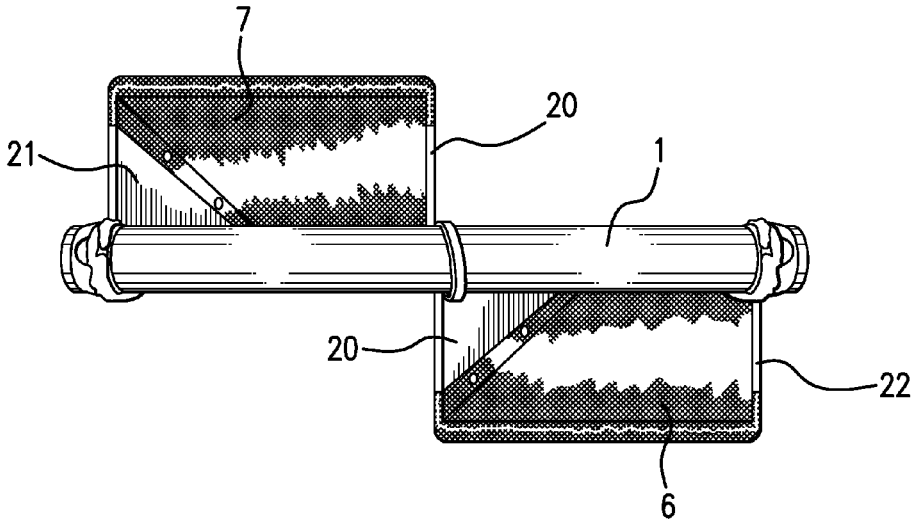
FIG. 3 provides an end view of the protective bridle of the present invention.

A wall 20, which is visible in FIG. 1, and more clearly shown in FIGS. 3 and 4, is located between the barrier sections 6 and 7, and closes off the space which would otherwise be formed by the upwardly or downwardly extending barrier sections. The wall 20 is generally perpendicular to the barrier sections, and is located between such sections. The wall 20 therefore contacts both barrier sections. The wall prevents the waterskier's hand, or other body part, from passing through the region of one barrier section to the other. In other words, the wall 20 insures that the space defined by the upwardly and downwardly extending barrier sections is closed off to the passage of a limb or other body part. The wall may be made of a mesh or a solid material, like that of the adjacent barrier sections.

The protective bridle also includes end walls 21 and 22, shown in FIGS. 1, 3, and 4, which further close off the region of the bridle, and further prevent the passage of any limb or other body part. The end walls may also be made of a mesh or of a solid material, like wall 20 and the barrier sections.

In addition to the upwardly and downwardly extending barrier sections, the bridle includes a flat plate 30, of generally triangular shape, disposed forward of the barrier sections (the term "forward" being defined as toward the boat and away from the waterskier). The plate is connected to the ski lines 2 and 3, such that it is held in its place within the triangular region defined by the bridle. The plate 30 not only fills out the space defined by the bridle, i.e. defined by the handle and the lines 2 and 3, but also serves to stabilize the bridle in the event that it falls into the water. If the waterskier should fall, or otherwise releases the bridle prematurely, the bridle will tend to spin in the water, twisting the ski lines and making them difficult to unravel. The plate 30 tends to reduce this tendency to spin, by resisting hydraulic forces exerted on the bridle.

Figure 5:
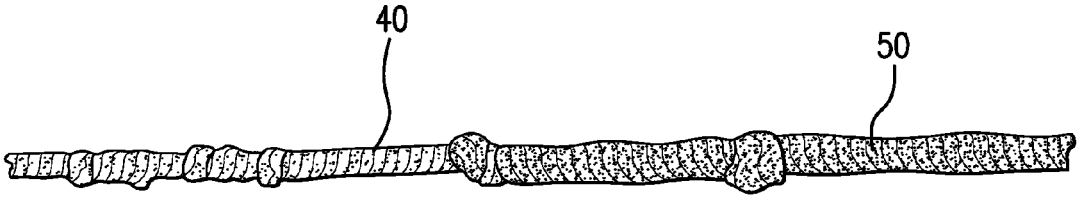
FIG. 5 provides a view of a pair of dissimilar ski lines, connected together so as to form a line having components of differing elasticities, as used in one embodiment of the present invention.

FIG. 5 illustrates another aspect of the present invention. FIG. 5 shows a waterski line, intended to connect a waterski bridle to a boat, in which the line includes two different lines 40 and 50, connected in series. The lines 40 and 50 have different elasticities, the line connected to the bridle being more elastic. The arrangement shown has the following effect.

A standard waterski line is made of a material which is relatively elastic, and which therefore stretches and contracts considerably during use. This line creates a bungee effect, which may pose difficulties for the beginning skier. Therefore, in the embodiment shown in FIG. 5, a portion of the waterski line has been effectively replaced with a line that has less elasticity, i.e. a line that tends not to stretch, and which has high tensile strength.

In using the embodiment represented by FIG. 5, the line section 40 is assumed to have lower tensile strength, and greater elasticity. Line section 40 is connected to the bridle. The line section 50, which is the high tension line, and which tends not to stretch, is connected to the motorboat (not shown).

As the skier gains experience and skill, part of the line having lower elasticity can be replaced with a material having greater elasticity. Eventually, the entire line can be a standard line, i.e. one having greater elasticity, and which therefore tends to stretch.

The various features described above may be combined in various ways. For example, one could produce a bridle having only the upwardly and downwardly extending barrier sections. One could also produce a bridle having only the flat plate, without the barrier sections. One could also combine the above features. Similarly, the bridle described above may be used with or without the line of FIG. 5 having sections of different elasticities.

The invention may be modified in still other ways. The invention is not limited to a particular material for the barrier. The barrier sections may be configured in different ways. These and other modifications, which will be apparent to the reader skilled in the art, should be considered within the spirit and scope of the following claims.

What is claimed is:

1. A protective bridle for waterskiing, comprising:

a) a handle, the handle having two ends, and a pair of ski lines extending respectively from the ends of the handle, the lines joining at a point such that the handle and the lines together define a generally triangular region, and b) a barrier which occupies at least a portion of said triangular region, wherein the barrier tends to prevent passage of a limb or other body part through said triangular region of the bridle, wherein the barrier comprises two sections, the sections of the barrier being inclined in mutually opposite directions, the bridle also including a wall located between the sections of the barrier and being generally perpendicular to said sections, the wall being in contact with both sections of the barrier so as to close off said triangular region from passage of a body part.

2. The protective bridle of claim 1, further comprising a generally flat plate, the plate occupying a portion of said triangular region.

3. The protective bridle of claim 2, wherein the flat plate has a generally triangular shape.

4. The protective bridle of claim 1, wherein the barrier is formed of a mesh.

5. The protective bridle of claim 1, wherein the bridle is connected, at said point, to a waterski line having distinct sections with differing elasticities.

6. A protective bridle for waterskiing, comprising:

a) a handle, the handle having two ends, and a pair of ski lines extending respectively from the ends of the handle, the lines joining at a point such that the handle and the lines together define a generally triangular region, and b) a barrier, disposed within said triangular region and occupying substantially all of said region, the barrier being connected to said lines, wherein the barrier is inclined away from the handle by an amount sufficient to permit a user to grasp the handle.

7. The protective bridle of claim 6, wherein the barrier itself has a generally triangular shape.

8. The protective bridle of claim 6, wherein the bridle is connected, at said point, to a waterski line having distinct sections with differing elasticities.

9. A protective bridle for waterskiing, comprising:

a) a handle, the handle having two ends, and a pair of ski lines extending respectively from the ends of the handle, the lines joining at a point such that the handle and the lines together define a generally triangular region, and b) a barrier comprising upwardly and downwardly oriented planar sections, the bridle also including a wall located between said sections of the barrier, the wall being generally perpendicular to said sections and being in contact with both sections, so as to close off said triangular region from passage of a body part.

10. The protective bridle of claim 9, further comprising end walls, connected respectively to the sections of the barrier, the end walls being generally perpendicular to said sections.

11. The protective bridle of claim 9, further comprising a generally flat plate which is connected to said lines, the plate occupying a portion of said triangular region.

12. The protective bridle of claim 11, the bridle being connected, at said point, to a waterski line having distinct sections of differing elasticities.

* * * * *